US006468368B1

(12) United States Patent
Merrick et al.

(10) Patent No.: US 6,468,368 B1
(45) Date of Patent: Oct. 22, 2002

(54) HIGH STRENGTH POWDER METALLURGY NICKEL BASE ALLOY

(75) Inventors: Howard Merrick, Phoenix, AZ (US); Raymond C. Benn, Groton, CT (US); Prabir R. Bhowal, Dayton, NJ (US)

(73) Assignee: Honeywell International, Inc., Morristown, NJ (US)

( * ) Notice: Subject to any disclaimer, the term of this patent is extended or adjusted under 35 U.S.C. 154(b) by 0 days.

(21) Appl. No.: 09/528,833

(22) Filed: Mar. 20, 2000

(51) Int. Cl.[7] ..... C22C 19/05
(52) U.S. Cl. ..... 148/428; 420/448
(58) Field of Search ..... 420/448; 148/428

(56) References Cited

U.S. PATENT DOCUMENTS

| | | | | | |
|---|---|---|---|---|---|
| 3,807,993 | A | * | 4/1974 | Dalai et al. | 75/171 |
| 3,887,363 | A | * | 6/1975 | Smashey et al. | 75/171 |
| RE28,681 | E | * | 1/1976 | Baldwin | 75/134 |
| 4,119,458 | A | | 10/1978 | Moore | 75/170 |
| 4,126,495 | A | * | 11/1978 | Ghosh | 148/32 |
| RE29,920 | E | * | 2/1979 | Baldwin | 75/134 F |
| 4,169,742 | A | * | 10/1979 | Wukusick | 148/32.5 |
| 4,207,098 | A | * | 6/1980 | Shaw | 75/171 |
| 4,358,318 | A | | 11/1982 | Merrick et al. | 420/449 |
| 4,388,124 | A | * | 6/1983 | Henry | 148/404 |
| 4,569,824 | A | * | 2/1986 | Duhl et al. | 420/448 |
| 4,668,312 | A | | 5/1987 | Benn et al. | 148/410 |
| 4,719,080 | A | | 1/1988 | Duhl et al. | 420/443 |
| 4,765,850 | A | | 8/1988 | Schweizer | 148/404 |
| 4,781,772 | A | | 11/1988 | Benn et al. | 148/404 |
| 4,885,216 | A | | 12/1989 | Naik | 428/680 |
| 4,894,089 | A | * | 1/1990 | Henry | 75/246 |
| 4,981,644 | A | | 1/1991 | Chang | 420/442 |
| 5,023,050 | A | * | 6/1991 | McKannan et al. | 420/448 |
| 5,068,084 | A | * | 11/1991 | Cetel et al. | 420/443 |
| 5,104,614 | A | * | 4/1992 | Ducrocq et al. | 420/448 |
| 5,330,711 | A | | 7/1994 | Snider | 420/448 |
| 5,370,497 | A | | 12/1994 | Doe et al. | 415/199.5 |
| 6,051,083 | A | * | 4/2000 | Tamaki et al. | 148/410 |
| 6,054,096 | A | * | 4/2000 | Duhl et al. | 420/448 |
| 6,217,286 | B1 | * | 4/2001 | Huang et al. | 416/241 R |

* cited by examiner

*Primary Examiner*—Roy King
*Assistant Examiner*—Harry D. Wilkins, III
(74) *Attorney, Agent, or Firm*—Robert Desmond, Esq.

(57) ABSTRACT

A nickel base super alloy composition wherein the ratio of molybdenum to tungsten or to the sum of tungsten and rhenium, $$\frac{Mo}{w} \quad \text{or,} \quad \frac{Mo}{w + Re}$$

Is in the range of about 0.25 to about 0.5 weight percent.

29 Claims, 3 Drawing Sheets

$$P=(T+460)(20+\log t)\times 1000$$

HIGH STRENGTH POWDER METALLURGY NICKEL BASE ALLOY

TECHNICAL FIELD OF THE INVENTION

The present invention relates generally to nickel base alloys, and more particularly to Powder Metallurgy (P/M) nickel base alloys having improved characteristics.

BACKGROUND OF THE INVENTION

Nickel base cast alloys have been extensively used for turbine parts and component designs requiring high temperature strength and corrosion resistance. Some of the more important characteristics needed for gas turbine components such as turbine rotor blades and disks include strength and ductility at elevated temperatures. In order to increase efficiency of gas turbine engine, it is desirable to operate such turbine rotor at the highest practical operating temperatures consistent with achieving the design lifetimes. The compositions of the present invention improve the performance of high work turbine engine designs, and thus provide the capability of operating such products at higher rim speeds. As a result, higher blade stresses and also higher stresses in the blade disk attachment and bore regions are able to be addressed and operating temperatures are able to exceed the capability of current disk alloys by about 200° F. Various nickel alloy designs are known but fail to address the particular problems that are addressed within the context of the present invention. For example, U.S. Pat. Nos. 4,119,458, 4,668,312, 4,765,850, 4,3358,318 and 4,981,644 all disclose nickel base superalloy systems which are known. Similarly, U.S. Pat. Nos. 4,781,772, 4,719,080, 4,885,216, 5,330,711 and 5,370,497 also relate to nickel base alloys particularly suited for gas turbine engine compositions. As will be appreciated, alloys systems of the nickel base superalloy type are similar in many respects. However, differences in various components, particularly the refractory elements molybdenum, tungsten and rhenium can have significant impact on the strength of the alloy formed and improving the properties of the gamma matrix.

SUMMARY OF THE INVENTION

The present invention comprises a nickel base super alloy composition which can be fabricated into polycrystal articles having an exceptional combination of properties.

In general, it has been found that by controlling the ratio of molybdenum to tungsten or to the sum of tungsten and rhenium, alloy strength in terms of tensile, creep and rupture strengths for a given grain size and temperature range can be maximized. In the context of the present invention, the present inventors have found that these benefits are obtained by controlling the ratio of:

$$\frac{Mo}{w} \text{ or, } \frac{Mo}{w+Re}$$

in the range of about 0.25 to about 0.5.

In general, the molybdenum is present in the nickel base superalloy compositions of the present invention in an amount between about 2 and about 3 weight percent whereas the sum of the tungsten and rhenium present in amount from about 4.5 to about 7.5. The broad composition range is thus from about 2 to 3 weight percent molybdenum, from about 4.5 to about 7.5 weight percent (tungsten plus rhenium.), from about 14 to about 18 weight percent cobalt, from about 10.0 to about 11.5 weight percent chromium, from about 3.45 to about 4.15 weight percent aluminum, from about 3.6 to about 4.2 weight percent titanium, from about 0.45 to about 1.5 weight percent tantalum, from about 1.4 to about 2.0 weight percent niobium, from about 0.03 to about 0.04 weight percent carbon, from about 0.01 to about 0.025 weight percent boron, from about 0.05 to about 0.15 weight percent zirconium with other elements optionally included in nickel base alloys.

In accordance with a further aspect of the present invention, the nickel base superalloys are substantially hafnium free and the sum of tantalum and niobium is in the range of about 2.5 weight percent.

Other features and advantages will be apparent from the specification and claims and from the accompanied drawings which illustrate an embodiment of the present invention.

BRIEF DESCRIPTION OF THE DRAWINGS AND TABLES

The present invention will hereinafter be described in conjunction with the following drawings and Tables.

DRAWINGS

TABLES

Figure 1:
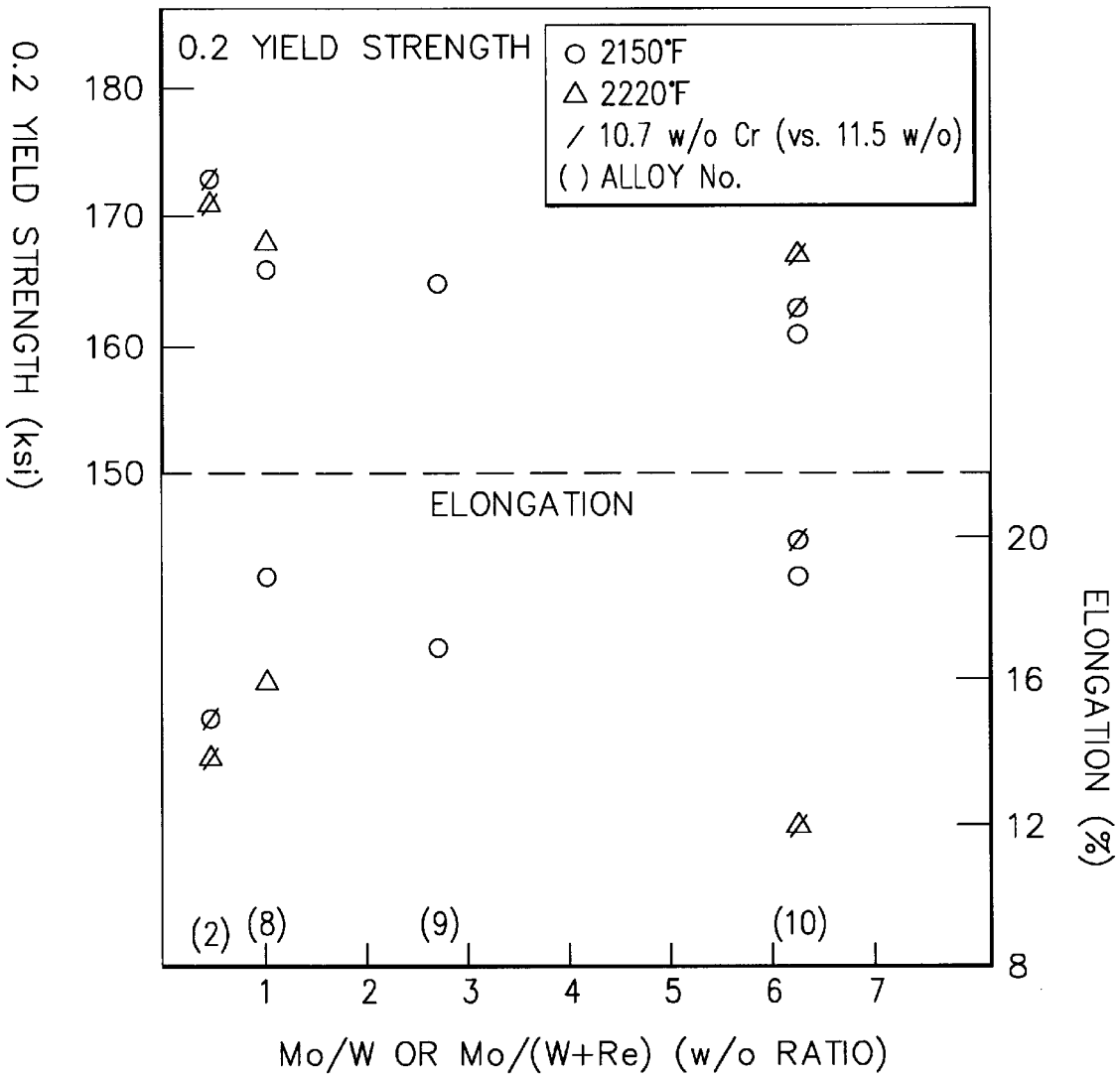
FIG. 1 shows graphs which illustrate the importance of the Mo/W or Mo/(W+Re) ratio's for alloys in accordance with the present invention, such as by showing the tensile properties of various alloy compositions.

Table 1 lists several composition ranges of varying scope for the composition of polycrystalline nickel base superalloys of the present invention.

Table 2 lists some examplary compositions with the following characteristics: (a) alloy 1 meets the preferred range of Mo/W or Mo/(W+Re) ratio but not within the range of Table I of present invention, (b) alloys 2, 3 and 4 are within the range of present invention i.e., meet the Mo/W or Mo/(W+Re) ratio's in the preferred range of 0.33 to 0.474 and within the range of Table I of present invention, and (c) alloys 8, 9 and 10 which do not meet the Mo/W or Mo/(W+Re) ratio's of the present invention but within the range of Table I of present invention. For reference, compositions of two known alloys, AF2-1 DA6 and AF115, are included in this Table.

Table 3 lists the actual compositions of the alloy made from the examplary compositions of Table II. Property illustrations are given from these alloys.

Table 4 lists the 0.2% creep and rupture lives from the examplary compositions of alloys 1, 2, 3 and 4. Alloy compositions 2, 3 and 4 of the present invention showed about 2 to 4 times improvement in life over alloy 1, which although meets the preferred range of Mo/W or Mo/(W+Re) ratio, fails to be within the range of Table I of present invention.

Table 5 list the tensile properties from the examplary compositions of alloys 1, 2, 3 and 4 for "subsolvus" fine grain size (ASTM 12.5 average) and test temperatures to 1500° F. Alloy 1 which is outside the composition range of present invention is typical of prior art material in these properties. The Table illustrates the superior tensile properties of alloy compositions 2, 3 and 4 of present invention. Tests for two cooling rates from the solution temperature are included.

Table 6 lists the tensile properties from the examplary compositions of alloys 1, 2, 3 and 4 for "near-solvus" coarser grain size (ASTM 10 average) and test temperatures to 1500° F. Alloy 1 which is outside the composition range of present invention is typical of prior art material in these properties. The Table illustrates the superior tensile properties of alloy compositions 2, 3 and 4 of present invention. Tests for two cooling rates from the solution temperature are included.

Table 7 lists the combination stress-rupture properties for tests at 300° F./110 ksi at notch concentration factors of $K_t$=2.4 and 3.4. The Table demonstrates excellent 1300° F. notch resistance of the example compositions of present invention at either $K_t$. The few notch failures at the much higher cooling rate of 675° F. per minute did not result in any reduction in the typical life. Test results of two grain sizes and two cooling rates are included.

Table 8 lists the combination stress-rupture properties for tests at 1400° F./80 ksi at notch concentration factors of $K_t$=2.4 and 3.4. The Table demonstrates excellent 1400° F. notch resistance of the example compositions of present invention at either Kt. The few notch failures did not result in any reduction in the typical life. Test results of two grain sizes and two cooling rates are included.

DESCRIPTION OF PREFERRED EXEMPLARY EMBODIMENTS OF THE INVENTION

Table 1 lists several composition ranges of varying scope for the composition of the polycrystal nickel base super alloys of the present invention. All percent figures in this application are weight percent figures unless otherwise indicated.

TABLE 1[1]

LIST OF SEVERAL COMPOSITION RANGES (WEIGHT %) OF VARYING SCOPE FOR POLYCRYSTALLINE NICKEL BASE SUPERALLOYS OF THE PRESENT INVENTION.

| | Co | Cr | Al | Ti | Ta | Nb | C | B | Zr | Mo | W + Re | N | O |
|---|---|---|---|---|---|---|---|---|---|---|---|---|---|
| Broad | | | | | | | | | | | | | |
| min | 14.0 | 10.0 | 3.45 | 3.60 | 0.45 | 1.4 | 0.03 | 0.01 | 0.05 | 2.0 | 4.5 | trace | trace |
| max | 18.0 | 11.5 | 4.15 | 4.20 | 1.5 | 2.0 | 0.04 | 0.025 | 0.15 | 3.0 | 7.5 | | |
| More Preferred | | | 3.8 | 3.9 | 0.75 | 1.7 | 0.03 | 0.02 | 0.09 | | | 1 ppm | 10 ppm |
| min | 14.7 | 10.2 | | | | | | | | 2.6 | 5.5 | | |
| max | 15.3 | 11.2 | | | | | | | | 3.0 | 7.5 | | |

[1]In each case Ni makes up the balance of the composition.

Nickel base superalloys such as are contemplated by the present invention and the compositions shown herein are developed with certain requirements in mind. In accordance with the present invention, high temperature performance is of importance. While various compositions are possible within the broad and preferred ranges of elements set forth in Table 1, the present inventors have found that within the ranges of Table I, certain compositional restrictions in terms of Mo/W or Mo/(W+Re) ratio's are particularly preferred and they exhibit, as will be described herein, advantageous performance characteristics. In the preferred embodiment the ratio of Mo/(W+Re) is in the range of 0.25 to 0.5. In an alternative embodiment wherein the composition does not contain rhenium, then the critical ratio is Mo/W which is in the range of about 0.25 to about 0.5.

For purposes of illustration only, exemplary compositions are set forth in Table 2 below along with a reference to the known alloys AF2-1DA6 and AF115 showing their Mo/W or Mo/(W+Re) ratio's. The "aim" chemistries are provided for these alloys, and only for alloys 1 to 4 the "max" and "min" ranges are given as typical. In each case Nickel makes up the balance of the composition. These example alloys of Table 2 are intended to be represenative of several cases in order to demonstrate the advantageous performance characteristics for alloys of the present invention. These cases are:

(a) The alloys 1, AF2-1 DA6 and AF115 meet the range of Mo/W or Mo/(W+Re) ratio's of the invention but not within the chemistry range of the present invention (Table I). Note that the alloy 1 is same as AF2-1 DA6 but with part of W replaced by Re while retaining the Mo/(W+Re) ratio at 0.43 (same as AF2-1 DA6).

(b) The example alloys 2, 3, 4 are those where the Mo/W or Mo/(W+Re) ratio's were controlled and the chemistries kept in each instance within the ranges of present invention. This ratio as exemplified by alloys 2, 3 and 4 is controlled to between about 0.25 and about 0.5, preferably between about 0.33 to about 0.474, and optimally to about 0.47. As will be appreciated, the ratio can be controlled in any number of ways. Preferably, however, the ratio is controlled by substituting Re for W in the compositions in accordance with the present invention.

(c) The example alloys 8, 9 and 10 do not meet the Mo/W or Mo/(W+Re) ratio's of the present invention but their chemistries are within the range of the present invention (Table I).

TABLE 2[1]

LIST OF SOME EXAMPLARY COMPOSITIONS

| Alloy | Co | Cr | Mo | W | Re | Al | Ti | Ta | Nb | C | B | Zr | Mo/ (W + Re) |
|---|---|---|---|---|---|---|---|---|---|---|---|---|---|
| 1 (max) | 10.3 | 12.5 | 3.0 | 3.7 | 3.2 | 4.65 | 3.3 | 1.8 | — | 0.04 | 0.025 | 0.15 | |
| 1 (aim) | 10.0 | 12.0 | 2.8 | 3.5 | 3.0 | 4.3 | 3.0 | 1.5 | — | 0.035 | 0.02 | 0.09 | 0.43 |
| 1 (min) | 9.7 | 11.5 | 2.6 | 3.3 | 2.8 | 3.95 | 2.7 | 1.2 | — | 0.01 | 0.01 | 0.05 | |
| 2 (max) | 15.3 | 11.2 | 3.0 | 6.1 | — | 4.15 | 4.2 | 1.05 | 2.0 | 0.04 | 0.025 | 0.15 | |
| 2 (aim) | 15.0 | 10.7 | 2.8 | 5.9 | — | 3.8 | 3.9 | 0.75 | 1.7 | 0.035 | 0.02 | 0.09 | 0.47 |
| 2 (min) | 14.7 | 10.2 | 2.6 | 5.7 | — | 3.45 | 3.6 | 0.45 | 1.4 | 0.03 | 0.01 | 0.05 | |
| 3 (max) | 15.3 | 11.2 | 2.5 | 6.1 | 1.2 | 4.15 | 4.2 | 1.05 | 2.0 | 0.04 | 0.025 | 0.15 | |
| 3 (aim) | 15.0 | 10.7 | 2.3 | 5.9 | 1.0 | 3.8 | 3.9 | 0.75 | 1.7 | 0.035 | 0.02 | 0.09 | 0.33 |
| 3 (min) | 14.7 | 10.2 | 2.1 | 5.7 | 0.8 | 3.45 | 3.6 | 0.45 | 1.4 | 0.03 | 0.01 | 0.05 | |
| 4 (max) | 15.3 | 11.2 | 2.5 | 3.1 | 3.2 | 4.15 | 4.2 | 1.05 | 2.0 | 0.04 | 0.025 | 0.15 | |
| 4 (aim) | 15.0 | 10.7 | 2.3 | 2.9 | 3.0 | 3.8 | 3.9 | 0.75 | 1.7 | 0.035 | 0.02 | 0.09 | 0.47 |
| min) | 14.7 | 10.2 | 2.1 | 2.7 | 2.8 | 3.45 | 3.6 | 0.45 | 1.4 | 0.03 | 0.01 | 0.05 | |
| 8 (aim) | 15 | 11.5 | 4.0 | 4.0 | — | 3.8 | 3.9 | 0.75 | 1.7 | 0.03 | 0.02 | 0.05 | 1.0 |
| 9 (aim) | 15 | 11.5 | 5.0 | 2.0 | — | 3.8 | 3.9 | 0.75 | 1.7 | 0.03 | 0.02 | 0.05 | 2.5 |
| 10 (aim) | 15 | 11.5 | 5.0 | 1.0 | — | 3.8 | 3.9 | 0.75 | 1.7 | 0.03 | 0.02 | 0.05 | 5.0 |
| AF2-IDA6 | 10 | 12 | 2.8 | 6.5 | — | 4.8 | 2.8 | 1.4 | — | 0.04 | — | — | 0.43 |
| AF115[2] | 15 | 11 | 2.8 | 5.7 | — | 3.8 | 3.8 | — | 1.7 | 0.04 | — | — | 0.49 |

[1]In each case Ni makes up the balance of the composition.
[2]0.75 Hf

Table 3 sets forth the actual compositions of the example alloys prepared for the purpose of illustrating the advantageous performance characteristics of the alloys of the present invention. These alloys were prepared by the Powder Metallurgy (P/M) route, and −270 mesh screened powders were consolidated by combinations of hot compaction, extrusion and forging. This was followed by solution treatment at select temperatures to control the grain size and then aging at 1400° F. for 16 hours. For the purposes of illustrating the impact of the Mo/W or Mo/(W+Re) ratio, momentary reference is now made to FIG. 1 which shows a plot of the tensile properties of some example alloys with respect to both yield strength and elongation. These properties are shown for sub-solvus (2150° F.) and supersolvus (2220° F.) solution temperatures[1]. As can be readily seen from FIG. 1, the Alloy 2 has excellent properties as compared to the other alloys (e.g., alloys 8, 9 and 10) which do not conform to the Mo/W ratio of the present invention.

[1] In the text, terminologies of sub-, near- and supersolvus solution temperatures are used to refer to a solution temperatures in relation to the gamma prime solvus temperature of the alloy. For the alloys of FIG. 1, the gamma prime solvus temperatures are typically in the range 2140 to 2180° F. A sub-solvus solution, typically 50–100° F. below the solvus results in a fine grain structure (e.g., ASTM 11–13), a near-solvus solution, typically 10–30° F. below the solvus results in an intermediate grain structure (e.g., ASTM 8–10), and a supersolvus solution, typically 20–50° F. above the solvus results in a coarser grain structure (e.g., ASTM 5–8).

TABLE 3

ACTUAL COMPOSITIONS OF EXAMPLE ALLOYS
(Ratio = Mo/W or Mo/(W + Re)
COMPOSITION (Wt %)

| Alloy | Co | Cr | Mo | W | Re | Al | Ti | Ta | Nb | C | B | Zr | Ratio |
|---|---|---|---|---|---|---|---|---|---|---|---|---|---|
| 1 (actual) | 9.9 | 11.6 | 2.8 | 3.5 | 2.8 | 4.18 | 2.9 | 1.3 | — | 0.03 | 0.024 | 0.09 | 0.44 |
| 2 (actual) | 14.8 | 10.4 | 2.8 | 5.9 | — | 3.64 | 3.8 | 0.69 | 1.6 | 0.03 | .022 | .09 | 0.47 |
| 3 (actual) | 14.8 | 10.5 | 2.8 | 5.2 | 0.91 | 3.64 | 3.8 | 0.69 | 1.6 | 0.03 | .022 | .09 | 0.46 |
| 4 (actual) | 14.8 | 10.6 | 2.7 | 2.9 | 2.8 | 3.91 | 3.9 | 0.70 | 1.6 | 0.03 | .023 | .09 | 0.47 |
| 8 (actual) | 14.7 | 11.7 | 4.1 | 4.0 | — | 3.6 | 3.9 | 0.79 | 1.7 | 0.032 | .019 | .05 | 1.02 |
| 9 (actual) | 15.0 | 11.5 | 5.1 | 1.9 | — | 3.6 | 3.9 | 0.80 | 1.7 | 0.036 | .018 | .05 | 2.68 |
| 10 (actual) | 15.1 | 10.7 | 5.1 | 0.82 | — | 3.6 | 4.0 | 0.80 | 1.7 | 0.034 | .020 | .05 | 6.22 |
| AF2-IDA6 | 9.9 | 11.8 | 2.8 | 6.5 | — | 4.8 | 2.8 | 1.4 | — | 0.04 | 0.020 | 0.08 | 0.43 |
| AF115* | 15.0 | 11.0 | 2.8 | 5.7 | — | 3.8 | 3.7 | — | 1.7 | 0.04 | 0.020 | 0.08 | 0.49 |

*0.7 Hf

Figure 2:
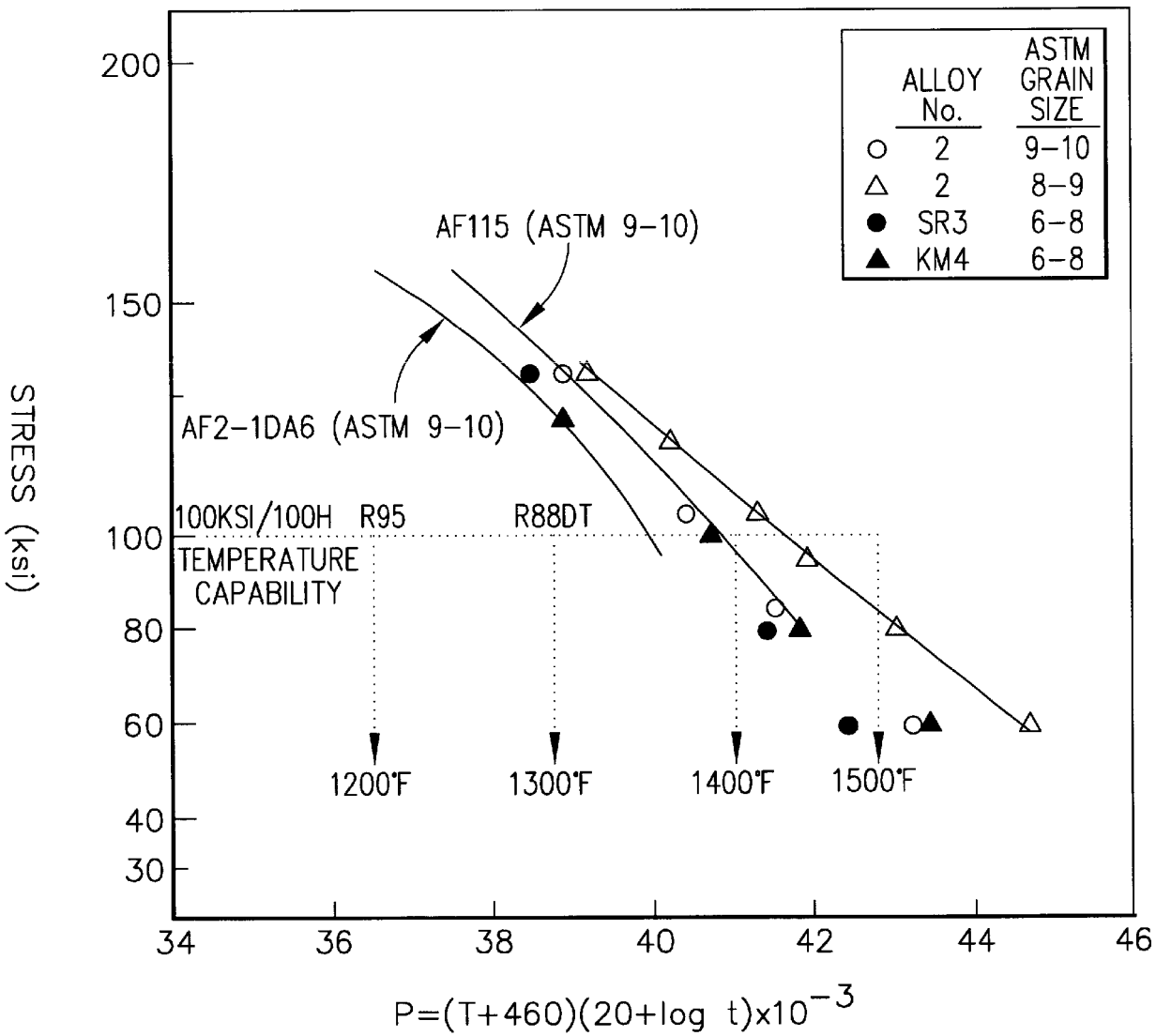
FIG. 2 is a graph which illustrates the rupture strength (stress axis) as a function of Larson-Miller Parameter P (i.e., stress-rupture life as a function of test temperature and time of test duration) for one embodiment of an alloy in accordance with the present invention as compared against various prior art materials.

For the purpose of demonstrating the increased creep properties of the alloys of present invention, reference is made to FIG. 2, where the stress-rupture property of one example alloy, Alloy 2, is compared with the known alloys AF2-1DA6 and AF115, and some other prior art materials. Special attention should be paid to the specified grain size since it is well known that grain size alone has a marked effect on creep resistance, for example, coarse grains (i.e., lower ASTM No.) providing more creep resistance than finer grains (i.e., higher ASTM No.). FIG. 2, as is shown, illustrates the rupture strength (stress axis) as a function of Larson-Miller Parameter P (i.e., stress-rupture life as a function of test temperature and time of test duration). It can be seen that the Alloy 2 of the present invention has increased performance for a given grain size and temperature. Such performance is believed to be obtained by controlling the Mo/W ratio in the Alloy 2. In alloys such as 3 and 4 of the present invention, the same increased performance is obtained by controlling the Mo/(W+Re) ratio. Rhenium as a slower diffuser than tungsten also may be important in slowing the gamma prime dissolution rate of grain growth kinetics and better in the sub- solvus heat treatments for ASTM grain sizes of about 8–10.

Figure 3:
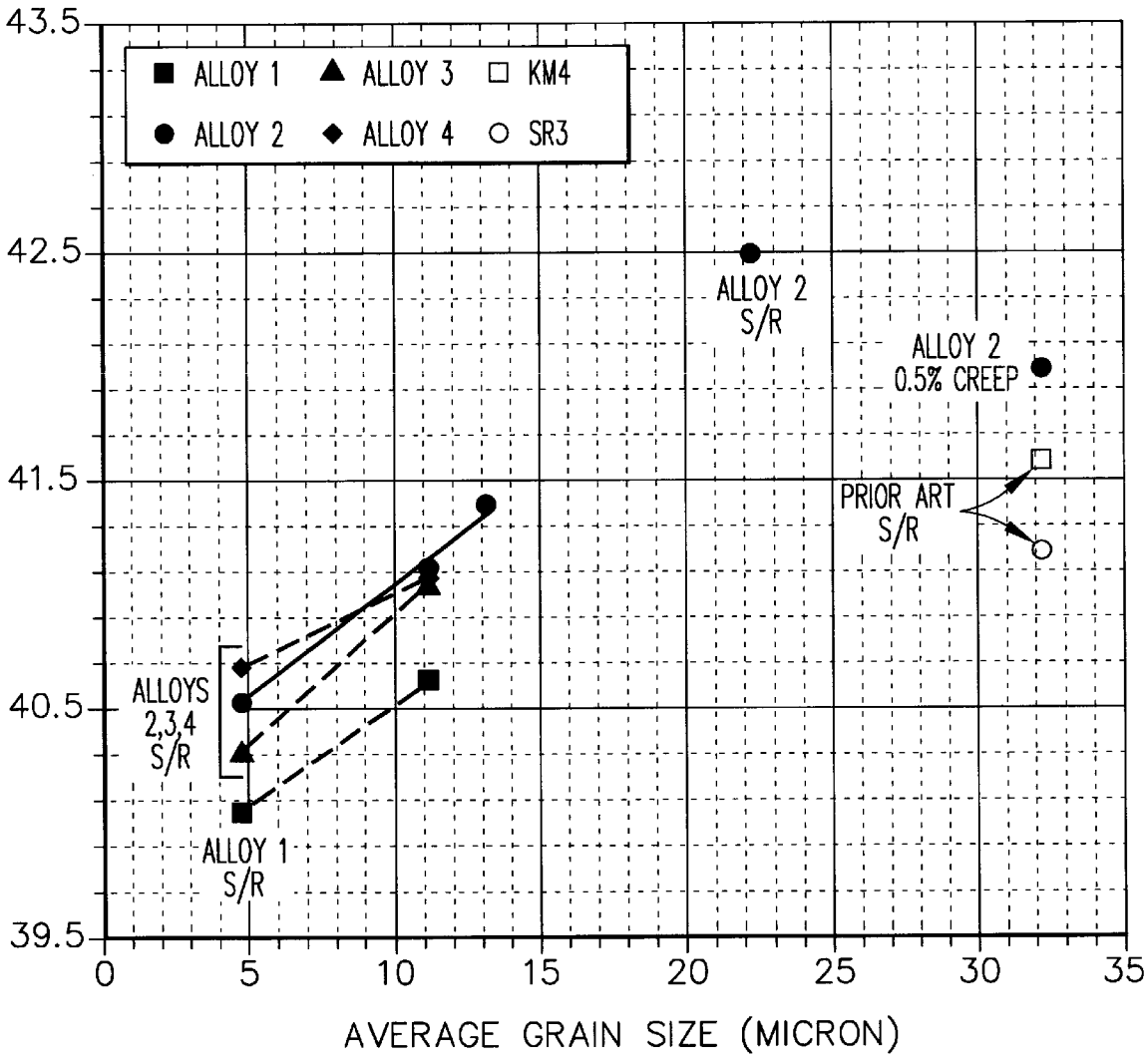
FIG. 3 shows graphs of stress-rupture life in terms of Larson-Miller Parameter P as a function of alloy grain sizes for four alloys with Mo/W or Mo/(W+Re) ratio's in the range 0.25 to 0.5 in accordance with the present invention as compared against various prior art materials.

In FIG. 3, we show that with the alloys of present invention, even with fine grains, creep resistance equivalent to some prior art materials of coarser grains is achieved through the alloy chemistry control. FIG. 3 shows graphs of stress-rupture life (expressed as Larson-Miller Parameter P) as a function of alloy grain sizes (expressed in micron) for four alloys (1 is to 4) with Mo/W or Mo/(W+Re) ratio's in the range 0.25 to 0.5 as compared against two prior art materials of FIG. 2. The Alloy 1 which is outside the chemistry range of the present invention (Table I) did not exhibit as good a stress-rupture property as the alloys 2, 3 and 4 which met both the Table I chemistry range and the Mo/W or Mo/(W+Re) ratio requirements of the present invention. When the alloys of the present invention are heat treated to obtain grain sizes, for example, ASTM 9–10 (about, 10–15 micron), the stress-rupture lives are equivalent to the prior art materials with grain sizes much coarser at ASTM 6–8 (about 32 micron average). When the alloys of the present invention are heat treated to obtain coarser grain sizes, for example, ASTM 6–8, then further improvements over the prior art material are obtained as shown in FIG. 3.

With reference back now to Table 3, and in particular Alloys 1–4 disclosed therein, various tests were conducted to demonstrate the improved performance and will be described in conjunction with the following examples.

EXAMPLE 1

Creep Resistance

Samples of Alloys 1–4 were made from −270 mesh powder composition through hot compaction, extrusion and isothermal forging in approximate size of 5 in. dia.×2 in. thick. The samples were given sub-solvus solution treatments at select temperatures to obtain fine grains of average size of ASTM 12.5 and slightly coarser grains of average size ASTM 10. The cooling rate from the solution temperature was about 230° F. per minute. The Alloy 1 which is not in the chemistry range of the present invention is included for reference.

Creep tests were conducted at various stress and elevated temperature conditions, and the 0.2% creep and rupture lives were determined as shown in Table 4 for subsolvus (ASTM 12.5) and near-solvus (ASTM 10) grain sizes. As in the case of stress-rupture life described earlier for Alloy 2 (ASTM 8–9) with reference to FIG. 3, the 0.2% and rupture lives were greatly improved for Alloys 2, 3 and 4 of the present invention relative to the reference Alloy 1.

TABLE 4

CREEP TEST RESULTS OF ALLOYS 1–4 FOR GRAIN SIZES ASTM 12.5 AND 10

| | | 0.2% Creep Life (h)[1] | | Rupture Life (h)[1] | |
|---|---|---|---|---|---|
| | Test Condition | ASTM 12.5 | ASTM 10 | ASTM 12.5 | ASTM 10 |
| 1 | 1300° F./125 ksi | 2.9 | 5.0 | 29.0 | 45.0 |
| 2 | 1300° F./125 ksi | 15.1 | 17.2 | 97.0 | 124.7 |
| 3 | 1300° F./125 ksi | 15.6 | 34.7 | 92.2 | 164.0 |
| 4 | 1300° F./125 ksi | 30.9 | 30.4 | 166.1 | 168.0 |
| 1 | 1400° F./80 ksi | 2.9 | 3.9 | 33.7 | 70.5 |
| 2 | 1400° F./80 ksi | 6.8 | 9.3 | 61.0 | 128.9 |
| 3 | 1400° F./80 ksi | 2.9 | 12.4 | 47.0 | 118.9 |
| 4 | 1400° F./80 ksi | 7.8 | 13.2 | 74.1 | 122.5 |
| 1 | 1400° F./100 ksi | 0.9 | 0.9 | 7.9 | 13.3 |
| 2 | 1400° F./100 ksi | 1.1 | 2.4 | 16.8 | 33.5 |
| 3 | 1400° F./100 ksi | 1.1 | 2.6 | 14.0 | 32.6 |
| 4 | 1400° F./100 ksi | 2.7 | 3.6 | 21.9 | 33.2 |
| 1 | 1450° F./80 ksi | | | 8.3 | 17.4 |
| 2 | 1450° F./80 ksi | | | 14.4 | 33.4 |
| 3 | 1450° F./80 ksi | | | 11.7 | 30.4 |
| 4 | 1450° F./80 ksi | | | 16.6 | 30.0 |
| 1 | 1500° F./60 ksi | | | 8.9 | 21.2 |
| 2 | 1500° F./60 ksi | | | 13.4 | 30.9 |
| 3 | 1500° F./60 ksi | | | 10.9 | 30.1 |
| 4 | 1500° F./60 ksi | | | 18.4 | 30.0 |

[1]Average of 2 tests

EXAMPLE 2

Tensile Properties for Sub and Near-Solvus Heat Treatments (ASTM 12.5 and 10, Average)

Tensile specimens were prepared from forgings of Alloys 1–4 and heat treated in a manner same as in Example 1. Alloy 1, not within the current invention, is included as reference. In the solution treatments, two select temperatures were used to obtain fine grains of average size of ASTM 2.5 (sub-solvus) and slightly coarser grains of average size ASTM 10 solvus), and two cooling rates were utilized from the solution temperature as specified in the Tables below. The tensile tests were conducted from room temperature (RT) to 1500° F., and the results, the 0.2% yeild strength, Ultimate Tensile Strength (UTS) and % Elongation, are given in Table 5 (for sub-solvus solution treatment) and Table 6 (for near-solvus solution treatment). The Tables show excellent performance characteristics of the Alloys 2–4 of the present invention.

TABLE 5

TENSILE PROPERTIES OF ALLOYS 1–4 FOR SUB-SOLVUS HEAT TREATMENT AVERAGE GRAIN SIZE ASTM 12.5

| Test Temp (F) | ALLOY 1 0.2% YS - UTS - % EL ksi - ksi - % | | | ALLOY 2 0.2% YS - UTS - % EL ksi - ksi - % | | | ALLOY 3 0.2% YS - UTS - % EL ksi - ksi - % | | | ALLOY 4 0.2% YS - UTS - % EL ksi - ksi - % | | |
|---|---|---|---|---|---|---|---|---|---|---|---|---|
| Solution Cooling Rate: 1200° F. Salt Bath, 230° F. per minute | | | | | | | | | | | | |
| RT | 167.2 | 240.5 | 22.0 | 182.4 | 255.4 | 18.5 | 191.6 | 259.9 | 16.2 | 186.5 | 256.6 | 18.7 |
| RT | 163.6 | 237.3 | 22.2 | 180.5 | 253.3 | 19.4 | 184.8 | 253.3 | 17.4 | 183.6 | 249.1 | 14.5 |
| 1300 | 152.3 | 183.8 | 13.3 | 164.0 | 198.7 | 11.3 | 171.1 | 198.2 | 14.1 | 169.6 | 196.0 | 10.8 |
| 1300 | 158.8 | 187.4 | 13.1 | 171.6 | 196.5 | 14.2 | 182.4 | 200.2 | 10.0 | 164.8 | 194.1 | 11.3 |
| 1400 | 144.0 | 160.1 | 11.0 | 156.2 | 170.8 | 11.1 | 163.2 | 175.9 | 9.5 | 159.8 | 171.6 | 9.1 |
| 1400 | 146.6 | 161.1 | 7.1 | 163.1 | 176.2 | 8.7 | 155.1 | 172.4 | 7.2 | 165.0 | 172.4 | 8.0 |
| 1450 | 135.4 | 150.4 | 9.7 | 151.2 | 157.1 | 7.8 | 143.2 | 166.9 | 5.2 | 153.5 | 163.9 | 7.0 |
| 1450 | 139.1 | 153.5 | 7.2 | 151.3 | 164.9 | 7.6 | 152.7 | 167.8 | 6.1 | 153.4 | 166.4 | 4.4 |
| 1500 | 118.1 | 134.9 | 9.4 | 127.2 | 140.3 | 9.3 | 132.7 | 150.9 | 5.4 | 139.5 | 148.4 | 6.6 |
| 1500 | 118.8 | 135.6 | 8.7 | 129.2 | 144.1 | 8.7 | 127.1 | 146.2 | 5.2 | 136.3 | 149.7 | 5.4 |
| Solution Cooling Rate: 1000° F. Salt Bath, 675° F. per minute | | | | | | | | | | | | |
| RT | 175.2 | 242.2 | 21.4 | 186.9 | 248.3 | 14.8 | 189.7 | 233.6 | 9.0 | 186.0 | 251.1 | 16.3 |
| RT | 167.5 | 235.5 | 17.1 | 181.3 | 145.8 | 14.4 | 186.0 | 236.8 | 11.3 | 183.0 | 252.0 | 18.2 |
| 1300 | 157.5 | 185.0 | 12.7 | 173.0 | 197.5 | 10.1 | 175.9 | 200.5 | 11.0 | 173.9 | 196.7 | 9.4 |
| 1300 | 160.1 | 191.3 | 11.0 | 169.1 | 199.5 | 8.6 | 170.3 | 200.0 | 11.1 | 171.0 | 196.7 | 11.7 |
| 1400 | 147.1 | 160.8 | 8.7 | 156.8 | 170.6 | 10.2 | 159.0 | 173.4 | 7.9 | 158.2 | 172.0 | 10.4 |
| 1400 | 150.0 | 164.4 | 8.6 | — | — | — | 166.2 | 177.8 | 6.8 | 167.5 | 177.6 | 7.9 |
| 1450 | 132.4 | 147.7 | 8.9 | 150.3 | 162.6 | 7.0 | 145.9 | 162.4 | 5.8 | 150.9 | 163.0 | 7.3 |
| 1450 | 143.5 | 157.7 | 5.2 | 155.4 | 165.8 | 4.5 | 150.0 | 163.1 | 6.4 | 152.7 | 164.0 | 5.3 |
| 1500 | 122.0 | 136.5 | 7.3 | 123.7 | 141.2 | 9.9 | 124.4 | 141.3 | 7.0 | 133.7 | 145.9 | 7.3 |
| 1500 | 122.8 | 140.2 | 8.0 | 130.7 | 144.8 | 6.6 | 128.7 | 147.9 | 6.6 | 135.2 | 146.8 | 6.3 |

TABLE 6

TENSILE PROPERTIES OF ALLOYS 1–4 FOR NEAR-SOLVUS HEAT TREATMENT AVERAGE GRAIN SIZE ASTM 10

| Test Temp (F) | ALLOY 1 0.2% YS - UTS - % EL ksi - ksi - % | | | ALLOY 2 0.2% YS - UTS - % EL ksi - ksi - % | | | ALLOY 3 0.2% YS - UTS - % EL ksi - ksi - % | | | ALLOY 4 0.2% YS - UTS - % EL ksi - ksi - % | | |
|---|---|---|---|---|---|---|---|---|---|---|---|---|
| Solution Cooling Rate: 1200° F. Salt Bath, 230° F. per minute | | | | | | | | | | | | |
| RT | 167.8 | 239.0 | 20.9 | 177.2 | 244.7 | 14.8 | 177.1 | 249.6 | 17.5 | 180.0 | 248.9 | 16.7 |
| RT | 162.7 | 236.5 | 20.6 | 173.3 | 243.6 | 16.9 | 173.2 | 246.5 | 18.1 | 176.2 | 239.2 | 13.7 |
| 1300 | 160.2 | 194.6 | 12.4 | 167.8 | 201.0 | 11.5 | 167.5 | 201.0 | 11.9 | 169.5 | 204.4 | 9.3 |
| 1300 | 156.5 | 191.2 | 12.8 | 164.9 | 202.2 | 14.8 | 160.4 | 196.2 | 15.4 | 166.7 | 200.5 | 10.2 |
| 1400 | 145.4 | 166.7 | 16.8 | — | — | — | 150.9 | 173.7 | 10.0 | 158.2 | 176.5 | 10.9 |
| 1400 | 148.3 | 168.5 | 13.6 | 151.1 | 174.6 | 12.9 | 158.0 | 175.9 | 8.9 | 154.6 | 176.6 | 8.0 |
| 1450 | 138.7 | 155.4 | 10.0 | 146.5 | 162.6 | 7.9 | 147.7 | 160.8 | 8.0 | 145.5 | 162.1 | 8.5 |
| 1450 | 149.5 | 164.5 | 4.5 | 149.4 | 167.5 | 4.1 | 159.2 | 172.0 | 3.5 | 150.3 | 168.0 | 3.6 |
| 1500 | 121.6 | 141.9 | 11.7 | 125.7 | 146.0 | 9.0 | 127.3 | 144.8 | 9.5 | 128.7 | 146.0 | 6.9 |
| 1500 | 132.1 | 152.8 | 4.2 | 141.5 | 157.1 | 3.2 | 140.9 | 156.6 | 4.0 | 140.4 | 156.2 | 3.6 |
| Solution Cooling Rate: 1000° F. Salt Bath, 675° F. per minute | | | | | | | | | | | | |
| RT | 169.5 | 240.8 | 21.1 | 184.7 | 247.7 | 14.5 | 184.8 | 248.3 | 14.3 | 180.7 | 247.6 | 14.6 |
| RT | 161.1 | 235.0 | 20.4 | 171.6 | 241.8 | 15.4 | 177.5 | 243.8 | 15.9 | 174.1 | 239.8 | 15.4 |
| 1300 | 157.6 | 190.8 | 12.6 | 166.7 | 200.7 | 12.3 | 172.0 | 207.9 | 10.8 | 168.3 | 201.5 | 10.5 |
| 1300 | 157.3 | 192.8 | 13.7 | 170.4 | 202.0 | 9.0 | 170.0 | 208.6 | 12.3 | 169.0 | 201.7 | 8.4 |
| 1400 | 144.1 | 165.5 | 11.2 | 153.8 | 169.6 | 12.9 | 157.1 | 176.3 | 9.1 | 157.0 | 176.6 | 11.6 |
| 1400 | 151.6 | 166.3 | 8.0 | 160.3 | 175.4 | 10.2 | 164.7 | 181.6 | 6.6 | 161.5 | 176.6 | 8.6 |
| 1450 | 137.8 | 152.4 | 9.1 | 151.2 | 163.9 | 9.4 | 152.9 | 168.6 | 6.5 | 150.6 | 165.3 | 6.9 |
| 1450 | 141.2 | 157.8 | 8.6 | 151.4 | 163.4 | 6.8 | 151.9 | 167.2 | 5.7 | 156.3 | 169.1 | 6.4 |
| 1500 | 125.1 | 137.0 | 10.3 | 125.9 | 144.3 | 8.7 | 130.1 | 145.9 | 7.3 | 132.6 | 146.5 | 8.9 |
| 1500 | 129.1 | 148.7 | 9.6 | 130.6 | 146.0 | 8.6 | 135.3 | 148.3 | 5.5 | 139.7 | 152.0 | 7.2 |

EXAMPLE 3

Notched Stress-Rupture at 1300° F.

Combination Notched Stress-Rupture specimens were prepared from forgings of Alloys 1–4 and heat treated in a manner same as in Example 2 for two grain sizes (sub-solvus and near-solvus heat treatments) and two cooling rates from the solution temperature. The Alloy 1 which is not within the chemistry range of the current invention, is included as reference. The tests were conducted at 1300° F. with a stress of 110 ksi, and with two stress concentration factors at the notch, i.e., a typical $K_t$=2.4 and a more severe $K_t$=3.4. The hours taken to rupture the specimen and the location of failure (i.e., S=failure in the smooth section of the bar and N=failure at the notch) are shown in Table 7.

As can be seen, good stress rupture characteristics were obtained. For example, at the lower cooling rate of 230° F. per minute, all failures occurred in the smooth sections of the bars at either $K_t$ and with lives similar to smooth stress-rupture tests. At the higher cooling rate of 675° F. per minute, although some failures occurred at the notch at $K_t$=3.4, there was no decrease in life. Thus, these alloys are not notch sensitive at the current test condition, and in particular, the Alloys 2–4 of the present invention show the characteristic high lives at 2 to 4 times over the reference Alloy 1. More specifically, Alloy 4, the composition of which is set forth in Table 2, appeared to be notch strengthened at both Kt=2.4 and 3.4 thus demonstrating high strength without any notch sensitivity.

EXAMPLE 4

Notched Stress Rupture at 1400° F.

Combination Notched Stress-Rupture tests were preformed on Alloy 1–4 which were processed in a manner identical to those described in Example 3 at an enhanced temperature conditions. The results are depicted in Table 8 below. As can be seen good stress rupture characteristics were obtained at the enhanced temperature. For example, all failures occurred in the smooth sections of the bars at $K_t$=2.4 and with lives similar to smooth stress-rupture tests. At the higher $K_t$=3.4, some failures occurred at the notch at $K^t$=3.4 but with no debit in the rupture life. Thus, these alloys, as in the previous example, are not notch sensitive in the enhanced temperature condition, and in particular, the Alloys 2–4 of the present invention show the characteristic high lives at 2 to 4 times over the reference Alloy 1.

TABLE 7

COMBINATION NOTCHED STRESS-RUPTURE DATA OF ALLOYS 1–4 FOR GRAIN SIZES ASTM 12.5 AND 10 TEST CONDITION 1300° F./110 ksi

| | | Rupture Life (h), FL[1] | | % Elongation | | % RA | |
|---|---|---|---|---|---|---|---|
| Alloy | $K_t$ | ASTM 12.5 | ASTM 10 | ASTM 12.5 | ASTM 10 | ASTM 12.5 | ASTM 10 |
| Solution Cooling Rate: 1200° F. Salt Bath, 230° F. per minute | | | | | | | |
| 1 | 2.4 | 111.4 (S) | 164.2 (S) | 8.1 | 10.3 | 8.6 | 11.2 |
| 1 | 3.4 | 99.5 (S) | 159.7 (S) | 9.9 | 5.6 | 11.7 | 9.8 |
| 2 | 2.4 | 239.4 (S) | 104.4 (S) | 11.2 | 7.2 | 12.8 | 11.9 |
| 2 | 3.4 | 252.3 (S) | 344.0 (S) | 14.1 | 10.3 | 19.5 | 13.1 |
| 3 | 2.4 | 210.2 (S) | 583.4 (S) | 9.2 | 8.1 | 11.1 | 9.8 |
| 3 | 3.4 | 164.7 (S) | 452.3 (S) | 14.3 | 16.8 | 14.6 | 18.4 |
| 4 | 2.4 | 414.6 (S) | 366.5 (S) | 14.3 | 10.4 | 16.0 | 11.8 |
| 4 | 3.4 | 284.2 (S) | 307.6 (S) | 11.5 | 7.0 | 17.1 | 8.6 |
| Solution Cooling Rate: 1000° F. Salt Bath, 675° F. per minute | | | | | | | |
| 1 | 2.4 | 38.1 (S) | 172.6 (S) | 2.8 | 6.6 | 3.8 | 12.6 |
| 1 | 3.4 | 59.6 (N) | 136.2 (N) | — | 7.8 | — | 9.8 |
| 2 | 2.4 | 291.3 (S) | 371.8 (S) | 10.4 | 10.4 | 12.3 | 10.6 |
| 2 | 3.4 | 232.3 (S) | 284.4 (N) | 14.4 | 8.7 | 16.2 | 13.1 |
| 3 | 2.4 | 267.0 (S) | 343.8 (S) | 10.9 | — | 13.7 | — |
| 3 | 3.4 | 209.0 (S) | 229.5 (N) | — | — | — | — |
| 4 | 2.4 | 441.4 (S) | 508.1 (S) | 16.2 | 7.0 | 17.5 | 8.8 |
| 4 | 3.4 | 330.8 (S) | 452.6 (S) | 14.6 | 12.4 | 18.8 | 12.3 |

[1]FL = Fracture Location in the combination stress-rupture bar, S = Failure in the smooth section, and N = Failure in the notch

TABLE 8

COMBINATION NOTCHED STRESS-RUPTURE DATA OF ALLOYS 1–4 FOR GRAIN SIZES ASTM 12.5 AND 10 TEST CONDITION 1400° F./80 ksi

| | | Rupture Life (h), FL[1] | | % Elongation | | % RA | |
|---|---|---|---|---|---|---|---|
| Alloy | $K_t$ | ASTM 12.5 | ASTM 10 | ASTM 12.5 | ASTM 10 | ASTM 12.5 | ASTM 10 |
| Solution Cooling Rate: 1200° F. Salt Bath, 230° F. per minute | | | | | | | |
| 1 | 2.4 | 25.9 (S) | 76.6 (N) | 10.1 | — | 12.2 | — |
| 1 | 3.4 | 33.1 (N) | 25.5 (N) | — | — | — | — |
| 2 | 2.4 | 61.7 (S) | 143.0 (S) | 15.9 | 12.0 | 18.1 | 15.7 |

TABLE 8-continued

COMBINATION NOTCHED STRESS-RUPTURE DATA OF ALLOYS 1–4 FOR GRAIN SIZES ASTM 12.5 AND 10 TEST CONDITION 1400° F./80 ksi

| | | Rupture Life (h), FL[1] | | % Elongation | | % RA | |
|---|---|---|---|---|---|---|---|
| Alloy | $K_t$ | ASTM 12.5 | ASTM 10 | ASTM 12.5 | ASTM 10 | ASTM 12.5 | ASTM 10 |
| 2 | 3.4 | 67.7 (S) | 143.3 (N) | 15.4 | — | 17.6 | — |
| 3 | 2.4 | 42.3 (S) | 155.5 (S) | 18.4 | 11.7 | 18.3 | 12.7 |
| 3 | 3.4 | 54.0 (S) | 161.5 (S) | 9.0 | 8.4 | 9.5 | 11.6 |
| 4 | 2.4 | 68.7 (S) | 93.6 (S) | 19.5 | 11.7 | 20.0 | 11.4 |
| 4 | 3.4 | 81.1 (S) | 77.2 (N) | 14.1 | — | 21.3 | — |
| Solution Cooling Rate: 1000° F. Salt Bath, 675° F. per minute | | | | | | | |
| 1 | 2.4 | 39.5 (S) | 74.5 (S) | 11.7 | 12.6 | 11.6 | 14.0 |
| 1 | 3.4 | 19.7 (N) | 55.3 (N) | — | — | — | — |
| 2 | 2.4 | 63.3 (S) | 117.7 (S) | 17.6 | 12.0 | 17.6 | 15.4 |
| 2 | 3.4 | 64.9 (S) | 109.6 (N) | 14.6 | — | 15.8 | — |
| 3 | 2.4 | 52.0 (S) | 102.3 (S) | 12.0 | 9.2 | 15.9 | 12.2 |
| 3 | 3.4 | 58.2 (N) | 76.0 (N) | — | — | — | — |
| 4 | 2.4 | 82.0 (S) | 144.2 (S) | 14.3 | 14.4 | 14.3 | 15.5 |
| 4 | 3.4 | 89.1 (S) | 145.0 (S) | 17.7 | 9.0 | 17.7 | 12.0 |

[1]FL = Fracture Location in the combination stress-rupture bar, S = Failure in the smooth section, and N = Failure in the notch

EXAMPLE 5

Microstructural Stability Under Temperature/Stress Exposure

Specimens from one of the example alloys (Alloy 2) in accordance with the present invention in a fine-grain structure (2150° F. Solution) were exposed to extended temperature and stress. (One specimen at 1300° F./120 ksi/792 hrs. and another specimen at 1400° F./85 ksi/176 hrs). After this extended exposure, the microstructure of the specimen was observed to have remained stable when compared to the unexposed microstructure. Two other specimens of the same example alloy in a coarser-grain structure (2220° F. Solution) were exposed to extended temperature and stress (One at 1300° F./120 ksi/784 hrs. and the other at 1400° F./85 ksi/255 hrs). Again, after this exposure, the microstructure was observed to have remained stable.

In general, the alloys of the present invention are processed through powder metallurgy (P/M) route as is typical for high performing P/M disk rotor alloys. Powder consolidation is initially done by hot compaction or isostatic hot pressing (HIP) followed by extrusion or extrusion and isothermal forging at elevated temperature for microstructural conversion. The solution cycle of the heat treatment is generally carried out at select temperatures to control the grain size is followed by cooling at rates to enhance the fineness of the precipitating gamma prime particles. A very fast cooling enhances this fineness with beneficial effects on properties but must be optimized against quench cracking tendencies and residual stress for specific part geometry.

The compositions of the present invention be given heat treatment accordingly, for example, sub-solvus heat treatment for fine grain microstructure may proceed by solution treatment for two hours at 2150° F. followed by fast air cooling, that is at a rate of about 500–700° F. per minute through at least 1800° F. followed by aging at 1400° F. for 16 hours. Thereafter, the product is air cooled. Alternatively, super-solvus heat treatment for a coarser grain microstructure may be used wherein the solution treatment is for two hours at 2210–2240° F. followed by fast air cooling and then aging as set forth above. Irrespective of the heat treatment procedure utilized, enhanced performance is observed, as shown in the examples above.

Within the broad ranges of compositions presented in Table 1, a particular relationship should be obeyed to obtain optimum properties. This relationship, previously briefly mentioned above, is to control the Mo/W or Mo/(W+Re) values in the range of about 0.25 to about 0.5, and optimally in the range of about 0.47. Such compositions have high strength in combination with stability. While it is apparent that the composition ranges in Table 1, particularly the broad composition range may encompass specific compositions in the art, so far as it is known to the inventors there are no prior art compositions wherein the ratio of Mo/W or Mo/(W+Re) is controlled. By controlling this ratio in the range of about 0.25 to 0.50 strength as measured in terms of tensile, creep, rupture, etc. for a given temperature and grain size is enhanced.

The improved temperature capabilities of the alloys of the present invention can be exploited in several ways. For example, operation at increased temperature can produce increased thrust or efficiency. The results of the testing shown in the various tables set forth herein were from tests conducted in conventional manner. That is, samples were tested in accordance with prescribed protocols and evaluated in a conventional fashion. These results offer temperature advantages over prior art compositions in the range of as much as 200° F.

As is known, the gamma prime phase ($Ni_3Al$) is the phase which tends to provide the most of the strength of the nickel base super alloys. Alloys of the present invention demonstrate some increased level of grain boundary gamma prime matrix formation. The present inventors believe such increased strength may be a result thereof.

It should be understood, however, that the invention is not limited to the particular embodiments shown and described herein, or to the particular manner by which such improved properties are obtained; various changes and modifications may be made without departing from the spirit and scope of this novel concept as defined by the following claims.

FIGURE CAPTIONS

FIG. 1—0.2% Yield Strength and % Elongation of Example Alloys 2, 7, 8 and 10 Illustrating the Importance of the Mo/W or Mo/(W+Re) Ratio's in Accordance with the Present Invention.

FIG. 2—Graphs Illustrating the Rupture Strength (Stress Axis) as a Function of Larson-Miller Parameter P (i.e., Test Temperature and Time of Test Duration) for One Embodiment of an Alloy in Accordance with the Present Invention as Compared Against Various Prior Art Materials.

FIG. 3—Graphs of Stress-Rupture Life in Terms of Larson-Miller Parameter P as a Function of Alloy Grain Sizes for Four Alloys with Mo/W or Mo/(W+Re) Ratio's in the Range 0.25 to 0.5 in Accordance with the Present Invention as Compared Against Some Prior Art Materials.

We claim:

1. A polycrystalline alloy composition comprising:

Ni, Co, Cr, Mo, W, Re, Al, Ti, Ta, Nb, C, B, Zr, O and N, wherein the weight ratio of Mo to (W+Re) is in the range of about 0.25–0.5 such that the alloy composition is substantially without notch sensitivity in enhanced temperature condition, the Ta is less than 6 wt %, and wherein the composition includes 2.0–3.0 wt % Mo, 4.5–7.5 wt % (W+Re), 14.0–18.0 wt % Co, 10.0–11.5 wt % Cr, about 3.45–4.15 wt % Al, about 3.6–4.2 wt % Ti, about 0.45–1.5 wt % Ta, about 1.4–2.0 wt % Nb, about 0.03–0.04 wt % C, about 0.01–0.025 wt % B, about 0.05–0.15 wt % Zr, and the balance Ni.

2. The composition of claim 1 comprising:

2.6–3.0 wt % Mo, 2.7–3.1 wt % W, and 2.8–3.2 wt % Re.

3. The composition of claim 1 comprising:

14.7–15.3 wt % Co; 10.2–11.2 wt % Cr; 3.8 wt % Al; 3.9 wt % Ti; 0.75 wt % Ta; 1.7 wt % Nb; 0.0–3 wt % C; 0.02 wt % B; 0.09 wt % Zr; and the balance Ni.

4. The composition of claim 3 comprising about 3.0 wt % Re.

5. A turbine disk made from the composition of claim 3.

6. The composition of claim 1 wherein the weight ratio is about 0.47.

7. The composition of claim 6 comprising about 4.0 wt % Re.

8. The composition of claim 1 comprising about 2.5 wt % of (Ta+Nb).

9. The composition of claim 1 comprising about 0.8–1.2 wt % Re.

10. The composition of claim 1 comprising about 1.0 wt % Re.

11. A turbine disk made from the composition of claim 1.

12. The composition of claim 1 comprising:

2.6–3.0 wt % Mo, and 5.5–6.3 wt % W.

13. A polycrystalline alloy composition comprising:

Ni, Co, Cr, Mo, W, Al, Ti, Ta, Nb, C, B, Zr, O and N, wherein the weight ratio of Mo to W is in the range of about 0.25–0.5 such that the alloy composition is substantially without notch sensitivity in enhanced temperature condition, the Ta is less than 6 wt %, and wherein the composition includes 2.0–3.0 wt % Mo, 4.5–7.5 wt % W, 14.0–18.0 wt % Co, 10.0–11.5 wt % Cr, about 3.45–4.15 wt % Al, about 3.6–4.2 wt % Ti, about 0.45–1.5 wt % Ta, about 1.4–2.0 wt % Nb, about 0.03–0.04 wt % C, about 0.01–0.025 wt % B, about 0.05–0.15 wt % Zr, and the balance Ni.

14. The composition of claim 13 comprising:

14.7–15.3 wt % Co; 10.2–11.2 wt % Cr; 3.8 wt % Al; 3.9 wt % Ti; 0.75 wt % Ta; 1.7 wt % Nb; 0.0–3 wt % C; 0.02 wt % B; 0.09 wt % Zr; and the balance Ni.

15. A turbine disk made from the composition of claim 14.

16. The composition of claim 13 wherein the weight ratio is about 0.47.

17. The composition of claim 13 comprising about 2.5 wt % of (Ta+Nb).

18. A turbine disk made from the composition of claim 13.

19. A polycrystalline alloy composition comprising:

14.0–18.0 wt % Co, 10.0–11.5 wt % Cr, 2.0–3.0 wt % Mo, 4.5–7.5 wt % (W+Re), about 3.45–4.15 wt % Al, about 3.6–4.2 wt % Ti, about 0.45–1.5 wt % Ta, about 1.4–2.0 wt % Nb, about 0.03–0.04 wt % C, about 0.01–0.025 wt % B, about 0.05–0.015 wt % Zr, and the balance Ni, wherein the weight ratio of Mo to (W+Re) is in the range of about 0.25–0.5 such that the alloy composition is substantially without notch sensitivity in enhanced temperature condition.

20. The composition of claim 19 comprising:

14.7–15.3 wt % Co, 10.2–11.2 wt % Cr, 3.8 wt %Al, 3.9 wt % Ti, 0.75 wt % Ta, 1.7 wt % Nb, 0.03 wt % C, 0.02 wt % B, 0.09 wt % Zr, and the balance Ni.

21. The composition of claim 20 comprising about 3.0% Re.

22. A turbine disk made from the composition of claim 20.

23. The composition of claim 19 comprising about 2.5 wt % of (Ta+Nb).

24. A turbine disk made from the composition of claim 19.

25. A polycrystalline alloy composition comprising:

14.0–18.0 wt % Co, 10.0–11.5 wt % Cr, 2.0–3.0 wt % Mo, 4.5–7.5% W, Re 3.46–4.15 wt % Al, about 3.6–4.2 wt % Ti, about 0.45–1.5 wt % Ta, about 1.4–2.0 wt. % Nb, about 0.03–0.04 wt % C, about 0.01–0.025 wt % B, about 0.05–0.015 wt % Zr, and the balance Ni, wherein the weight ratio of Mo to W is in the range of about 0.25–0.5 such that the alloy composition is substantially without notch sensitivity in enhanced temperature condition.

26. A composition of claim 25 comprising:

14.7–15.3 wt % Co, 10.2–11.2 wt % Cr, 3.8 wt % Al, 3.9 wt % Ti, 0.75 wt % Ta, 1.7 wt % Nb, 0.0–3 wt % C, 0.02 wt % B, 0.09 wt % Zr, and the balance Ni.

27. A turbine disk made from the composition of claim 25.

28. The composition of claim 25 comprising about 2.5 wt % of (Ta+Nb).

29. A turbine disk made from the composition of claim 25.

* * * * *